United States Patent [19]

Daenen et al.

[11] 4,385,554

[45] May 31, 1983

[54] STORAGE AND SERVING DISH FOR CHEESE

[75] Inventors: Robert H. C. M. Daenen, Hekelgem; Pieter K. Jan De Coster, Aalst, both of Belgium

[73] Assignee: Dart Industries Inc., Northbrook, Ill.

[21] Appl. No.: 248,090

[22] Filed: Mar. 27, 1981

[51] Int. Cl.[3] ..... A47J 43/18; B65D 25/06

[52] U.S. Cl. ..... 99/645; 220/22; 220/22.2; 220/22.3; 150/0.5; D7/43

[58] Field of Search ..... 220/22, 22.2, 22.3; 150/0.5; D7/43; 99/645

[56] References Cited

U.S. PATENT DOCUMENTS

| | | | |
|---|---|---|---|
| 170,223 | 11/1875 | Black . | |
| 488,598 | 12/1892 | Black . | |
| 846,634 | 3/1907 | Van Deventer et al. . | |
| 925,489 | 6/1909 | Lindsay . | |
| 1,290,186 | 1/1919 | Held | 220/22 |
| 2,070,829 | 2/1937 | Everly . | |
| 2,546,800 | 3/1951 | Thiac | 220/22 |
| 2,595,696 | 5/1952 | Paul . | |
| 2,598,789 | 6/1952 | Harrell | 220/22 |
| 2,617,350 | 11/1952 | Shol . | |
| 2,664,810 | 1/1954 | Halbriter . | |
| 2,716,066 | 8/1955 | Baker . | |
| 3,426,935 | 2/1969 | Swett | 150/0.5 |
| 3,511,288 | 5/1970 | Swett et al. | 150/0.5 |
| 3,677,168 | 7/1972 | Bell | D7/43 |

FOREIGN PATENT DOCUMENTS

| | | | |
|---|---|---|---|
| 892677 | 2/1962 | United Kingdom | 220/22.3 |

*Primary Examiner*—George E. Lowrance
*Attorney, Agent, or Firm*—Leigh B. Taylor

[57] ABSTRACT

A storage and serving dish particularly constructed to retain a foodstuff of a generally unstable consistency and more particularly camembert cheese. The dish includes a dam or holder for product which is articulated and adapted to engage the severed portions of a cheese block positioned on a base member of the dish. Such dam includes means to removably fix one portion thereof to the base while another portion is freely movable to alternative positions within the circumference of the base. In addition, the freely positionable dam portion is also fixedly positioned by engagement with the dish closure when such is placed thereon.

5 Claims, 7 Drawing Figures

STORAGE AND SERVING DISH FOR CHEESE

This invention relates to culinary devices of the type designed for the storage and serving of freshly cut food products. More particularly, such device is intended for use with camembert cheese products and includes a dam member having plate-like members to engage, support and shield the exposed edges of a freshly cut cheese brick.

Heretofore, cheese, pie and cake protectors have been provided as individual items suitable for use in a variety of differing environments but usually predicated upon the food product to be protected. These protectors, for the most part, employed somewhat complicated hinged structures for the food protecting plates. Furthermore, these protectors relied upon either the protected product itself or spring-means to retain the plates in their protective positions.

It should be appreciated that spring actuated protector plates are complicated and unwieldy thereby presenting problems for the user. Similarly, those which rely upon the product itself for support are unsatisfactory if that product is not sufficiently self-supporting.

Therefore, it is a principal object of the invention to provide an improved protector for application to and covering the exposed cut surfaces of cakes, cheese, pies and the like in combination with a storage and serving container for the particular food product.

Another object of this invention is to provide an improved dam, shield or holder that is fixedly maintained in contact with the food product by the base and closure of the device.

A further object of the invention is to provide a dam or the like for food product that may readily be positioned in contact with that product over an angle of approximately 300°.

Further objects and advantages of the invention will become more apparent from a reading of the following description, claims and drawings wherein:

Figure 1:
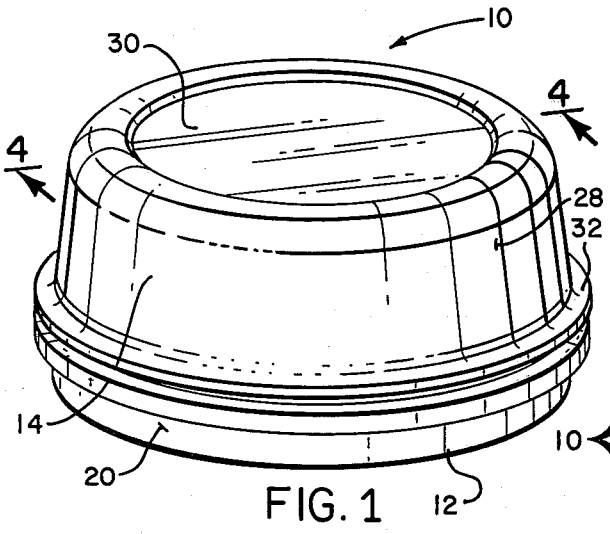
FIG. 1 is a top perspective view of the storage and serving dish of this invention.
Figure 2:
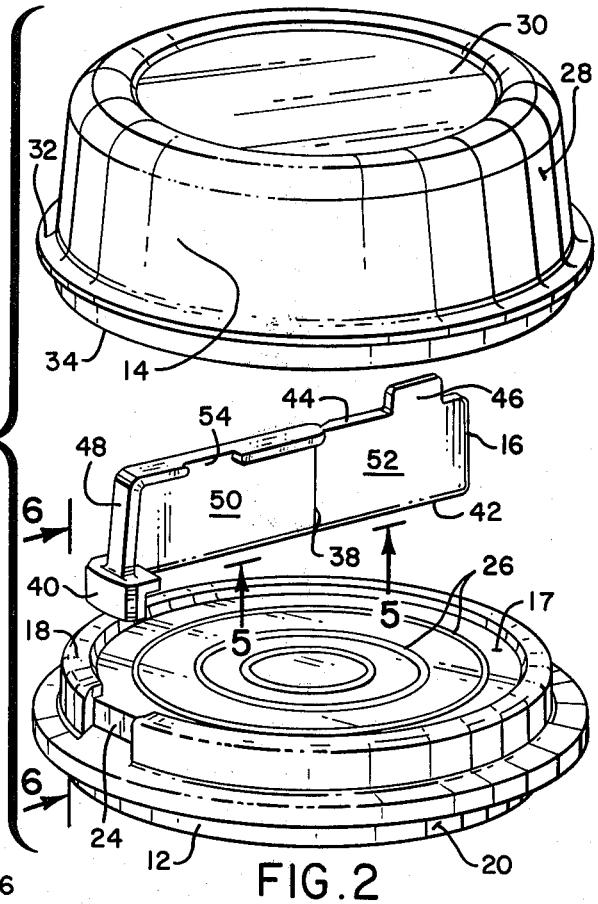
FIG. 2 is an exploded top perspective view of the storage and serving dish of this invention more fully disclosing the relationship of the respective parts of the device including the dam or holder.
Figure 3:
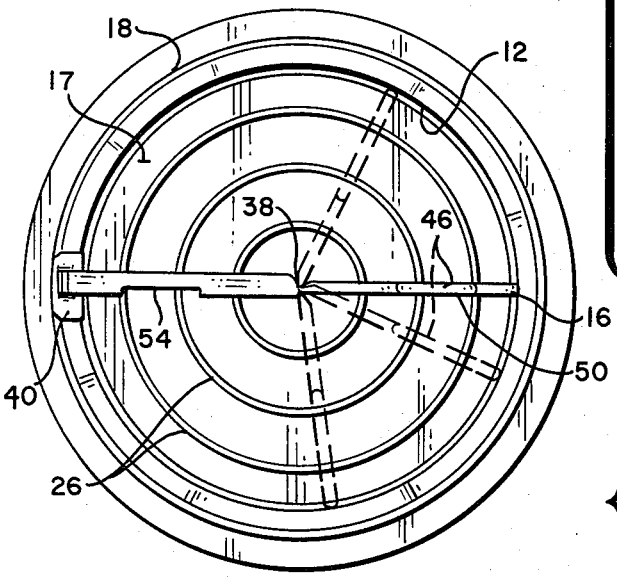
FIG. 3 is a top plan view of the dish base and dam with several of the various possible positions of the movable dam portion being shown in phantom (reference line 3—3 of FIG. 4)
Figure 4:
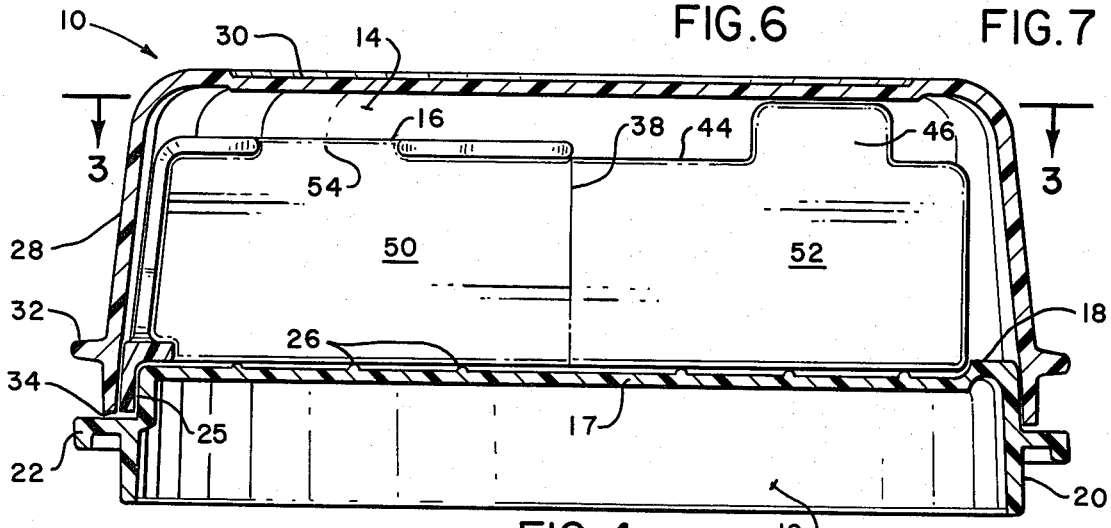
FIG. 4 is a cross-section side elevational view of the assembled storage and serving dish of this invention taken along line 4—4 of FIG. 1 illustrating the engagement between dish elements.

Referring more particularly to the drawing by characters of reference FIGS. 1, 2 and 4 illustrate the cheese storage and serving dish 10 of this invention which includes a base 12, closure 14 and dam or holder 16. Of particular importance to the invention is the respective engagement between these elements.

The base 12 is integrally formed and includes a slightly recessed bottom wall 17 bounded by an annulus or peripheral rim 18. The wall element 20 depends from annulus 18 and is bounded at its approximate mid-point by flange 22. This flange 22 and its position along wall 20 provides a handle for the device and suitable stop for the closure 14. Note also that the wall 20 at its extremities opposite bottom wall 17 is so shaped to accommodate the closure 14 being positioned thereon. Accordingly, even though the drawing figures show a preferred arrangement for container use, for storage purposes the closure 14 may be oppositely positioned on base 12.

Figure 6:
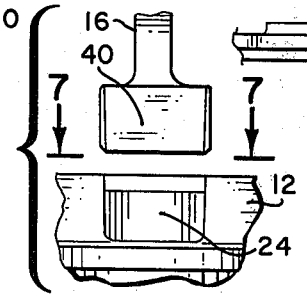
FIG. 6 is a partial side elevation taken along line 6—6 of FIG. 2 more particularly showing the means by which the dam and base are removably fixed to one another.
Figure 5:
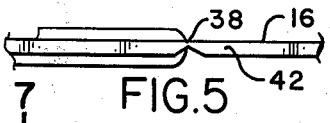
FIG. 5 is a partial bottom view of the dam taken along line 5—5 of FIG. 2.
Figure 7:
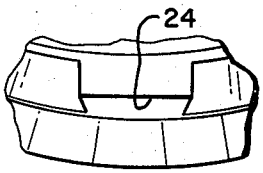
FIG. 7 is a partial top plan view of the base portion of the storage and serving dish also better illustrating the dovetailed slot into which the dam is inserted.

The annulus or peripheral rim 18 is interrupted at 24, which interruption takes the form of a vertically arranged dovetailed slot most readily apparent in FIGS. 2, 6 and 7 and more fully discussed hereinafter. Such interruption is further accommodated by the misalignment of wall segment 25.

The recessed bottom wall 17 may also be provided with circular ribs 26 to assist the user in centering the food product thereon.

Closure 14 is comprised of side wall 28 and top wall 30. Such is positionable on base 12 as is hereinabove described. Furthermore, side wall 28 includes a peripherally extending supporting flange 32 adjacent its terminal edge 34.

A critical element of the invention is dam, shield or holder 16 which includes an articulated planar segment 36, such being divided by a living hinge 38. Accordingly, planar portions 50, 52 are movable with respect to one another through approximately 300° of motion. One side edge of segment 36 and planar portion 50 is also provided with a reinforcing lip 48 and the dovetailed male member 40 the latter extending below the bottom edge 42 of segment 36.

The dovetailed male member 40 is, of course, accommodated in the dovetailed slot 24 in base 12. Such engagement thereby removably fixes one portion 50 of segment 36 with respect to the base 12 while still allowing another portion 52 thereof to arcuately move by means of the rotation of hinge 38. Planar portion 50 may, therefore, be positioned against one cut surface of a cheese block, for example, and the other planar portion 52 may thereafter be moved against the other cut surfaces as they progress around the block.

The top edge 44 of holder 16 includes an extension of lip 48 along portion 50 and further includes a detent 46 in portion 52. Lip 48 is, also, cutaway at 54 to accommodate detent 46 allowing portions 50, 52 to be juxtaposed with respect to each other. This detent 46 is adapted to engage the underside of closure 14 when it is in place on base 12. Thus, when the dish is assembled, both portions 50 and 52 of holder 16 are positively retained against the cut surfaces of product retained in the dish. This, furthermore, assures that an unstable product such as camembert cheese will be positively supported to prevent its flowing into that area from which product has been previously removed. Likewise, it is unnecessary with this structural arrangement, to rely on the stored product to actively support the holder 16.

Although the structure hereinabove described relates primarily to a cheese storage and serving dish or container, it should be appreciated that the same principles may be applied to containers for different food product of similar nature or with which it is desirable to shield product cut surfaces.

Similarly, it is apparent from the foregoing that this new device has advantages beyond those known in the prior art and that although it is preferred that same be made of molded plastic material, others may be employed if so desired.

I claim:

1. A storage and serving device for cheese or other foodstuff of a relatively unstable consistency, said device comprising a base and a holder, said base including a generally planar foodstuff-receiving bottom wall, a low peripheral rim area about said bottom wall, said holder being elongated and of a height, between top and bottom edges, to project substantially above said rim area, said holder comprising first and second generally planar portions, each portion having an inner and an outer end, said inner ends being hingedly interconnected for selective angular orientation of the second portion relative to the first portion for accommodation of the portions against cut edges of foodstuffs, said outer ends constituting opposed outer ends of the holder, said holder being positionable vertically in transversely overlying relation on the bottom wall with the bottom edge of the holder on said bottom wall, mounting means for fixing the outer end of said first portion to said rim area, said mounting means being a projecting member rigid with the bottom edge of the holder and depending therefrom at the outer end of said first holder portion and a slot through said rim area receiving and retaining said projecting member, said mounting means retaining the fixed outer end and the adjoining holder portion against both pivotal and peripheral movement, the second holder portion having the outer end thereof free of the bottom wall and rim area, said second portion being angularly adjustable relative to the retained holder portion.

2. The storage end serving device of claim 1 wherein said member and said opening are configured for non-rotational reception of the member within the opening.

3. A storage and serving device for cheese or other foodstuff of a relatively unstable consistency, said device comprising a base, a holder, and a closure; said base including a generally planar foodstuff-receiving bottom wall, a low peripheral rim area about said bottom wall; said holder being elongated and of a height, between top and bottom edges, to project substantially above said rim area, said holder comprising first and second generally planar portions, each portion having an inner and an outer end, said inner ends being hingedly interconnected for selective angular orientation of the second portion relative to the first portion for accommodation of the portions against cut edges of foodstuffs, said outer ends constituting opposed outer ends of the holder, said holder being positionable vertically is transversely overlying relation on the bottom wall with the bottom edge of the holder on said bottom wall, mounting means for fixing the outer end of said first portion to said rim area, said mounting means retaining the fixed outer end and the adjoining holder portion against both pivotal and peripheral movement, the second holder portion having the outer end thereof free of the bottom wall and rim area, said second portion being angularly adjustable relative to the retained holder portion; said closure being receivable over said base and the holder positionable thereon, said closure including a top wall and being physically engageable with the second angularly adjustable holder portion, for retaining said second portion against movement.

4. The storage and serving device of claim 3 wherein said second holder portion comprises a vertically projecting detent on the top edge thereof engageable with the top wall of the closure to define the physical engagement which retains said second portion against movement.

5. The storage and serving device of claim 4 wherein said mounting means is a projecting member rigid with the bottom edge of the holder and depending therefrom at the outer end of said first holder portion and a slot through said rim area receiving and retaining said projecting member.

* * * * *